US011005191B1

(12) United States Patent
Gunnels

(10) Patent No.: US 11,005,191 B1
(45) Date of Patent: May 11, 2021

(54) OMNI-DIRECTIONAL HORIZONTALLY POLARIZED ANTENNA SYSTEM

(71) Applicant: PC-TEL, Inc., Bloomingdale, IL (US)

(72) Inventor: Robert Gunnels, Homer Glen, IL (US)

(73) Assignee: PC-TEL, Inc., Bloomingdale, IL (US)

( * ) Notice: Subject to any disclaimer, the term of this patent is extended or adjusted under 35 U.S.C. 154(b) by 0 days.

(21) Appl. No.: 16/675,923

(22) Filed: Nov. 6, 2019

(51) Int. Cl.

| | |
|---|---|
| ***H01Q 21/24*** | (2006.01) |
| ***H01Q 21/20*** | (2006.01) |
| ***H01Q 9/30*** | (2006.01) |
| ***H01Q 1/36*** | (2006.01) |
| ***H01Q 13/10*** | (2006.01) |

(52) U.S. Cl.
CPC ..... *H01Q 21/205* (2013.01); *H01Q 1/36* (2013.01); *H01Q 9/30* (2013.01); *H01Q 13/106* (2013.01); *H01Q 21/24* (2013.01)

(58) Field of Classification Search
CPC ..... H01Q 21/205; H01Q 1/36; H01Q 9/30
USPC ..... 343/700 R
See application file for complete search history.

(56) References Cited

U.S. PATENT DOCUMENTS

| | | | | |
|---|---|---|---|---|
| 3,924,205 | A | 12/1975 | Hansen et al. | |
| 4,342,034 | A * | 7/1982 | Monser | H01Q 15/244 343/756 |
| 4,503,379 | A | 3/1985 | Raiman | |
| 2015/0311599 | A1 * | 10/2015 | Shtrom | H01Q 9/285 343/833 |

FOREIGN PATENT DOCUMENTS

| | | | |
|---|---|---|---|
| CN | 108011194 | A | 5/2018 |
| DE | 3122016 | A1 | 12/1982 |

OTHER PUBLICATIONS

Hori et al., Horizontally Polarized Omni-directional Antenna Using Orthogonal Polarization Conversion FSS, 2017 International Workshop on Antenna Technology: Small Antennas.
Innovative Structures, and Applications (iWAT).
European Search Report for EP patent application 20 20 5777.4, dated Mar. 26, 2021.
Kumar et al., "Ultra Broad Band Slant Polarized Omni Azimuthal Antenna", Proceedings of the Antennas and Propagation Society International Symposium (APSIS), Ann Arbor, Jun. 28-Jul. 2, 1993, vol. 1, pp. 482-485, dated Jun. 28, 1993.
Dastranj et al., "High-Performance 45° Slant-Polarized Omnidirectional Antenna for 2-66-GHz UWB Applications", IEEE Transactions on Antennas and Propagation, IEEE Service Center, Piscataway, NJ, U.S., vol. 64, No. 2, pp. 815-820, dated Feb. 1, 2016.
English-language translation of CN patent publication 108011194, dated May 8, 2018.
English-language translation of DE patent publication 3122016, dated Dec. 23, 1982.

* cited by examiner

*Primary Examiner* — Peguy Jean Pierre
(74) *Attorney, Agent, or Firm* — Husch Blackwell LLP

(57) ABSTRACT

An omni-directional horizontally polarized antenna system is provided that can include an omni-directional vertically polarized antenna and a plurality of linear polarization filters concentrically surrounding the omni-directional vertically polarized antenna. The omni-directional vertically polarized antenna can generate a vertically polarized field, and the plurality of linear polarization filters can progressively rotate the vertically polarized field 90° to form a horizontally polarized field outside of the plurality of linear polarization filters.

20 Claims, 6 Drawing Sheets

OMNI-DIRECTIONAL HORIZONTALLY POLARIZED ANTENNA SYSTEM

FIELD

The present invention generally relates to radio frequency (RF) communications hardware. More particularly, the present invention relates to an omni-directional horizontally polarized antenna system.

BACKGROUND

Known omni-directional horizontally polarized antenna systems can be constructed in many forms, such as slotted coaxial cable antenna systems, slotted waveguide antenna systems, turnstile antenna systems, and horizontal loop antenna systems. However, these known antenna systems lack good azimuth pattern control and stability over a wide frequency bandwidth.

In view of the above, there is a continuing, ongoing need for improved antenna systems.

DETAILED DESCRIPTION

Figure 1:
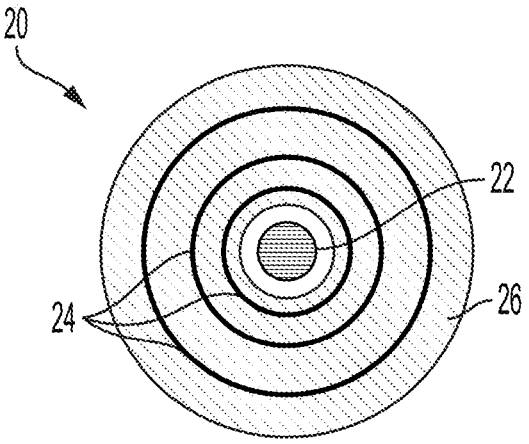
FIG. 1 is a block diagram of an antenna system according to disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include an omni-directional horizontally polarized antenna system that can include a vertically polarized co-linear antenna array adapted to function as an omni-directional horizontally polarized antenna by use of concentric linear polarization filters. In some embodiments, the concentric linear polarization filters can progressively rotate a polarization of the vertically polarized co-linear antenna array 90° between a region inside of the concentric linear polarization filters and a region outside of the concentric linear polarization filters. Various embodiments of the concentric linear polarization filters are contemplated, including, for example, wires attached to cylindrical dielectric supports, conductive strips attached to dielectric cylinders, conductive ink printed on the dielectric cylinders, and self-supporting versions of the concentric linear polarization filters that do not require the dielectric supports or the dielectric cylinders.

FIG. 1 is a block diagram of an antenna system 20 according to disclosed embodiments. As seen in FIG. 1, the antenna system 20 can include an omni-directional vertically polarized antenna 22 and a plurality of linear polarization filters 24, wherein the omni-directional vertically polarized antenna 22 can generate a vertically polarized field. As seen in FIG. 1, in some embodiments, the plurality of linear polarization filters 24 can concentrically surround the omni-directional vertically polarized antenna 22 and can progressively rotate the vertically polarized field 90° to form a horizontally polarized field outside of the plurality of linear polarization filters 24. In some embodiments, the plurality of linear polarization filters 24 can be coupled to and supported by one or a plurality of dielectric supports 26.

Figure 2:
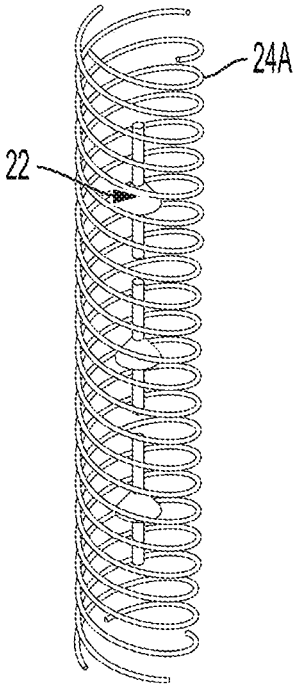
FIG. 2 is a perspective view of a portion of an antenna system according to disclosed embodiments.
Figure 3:
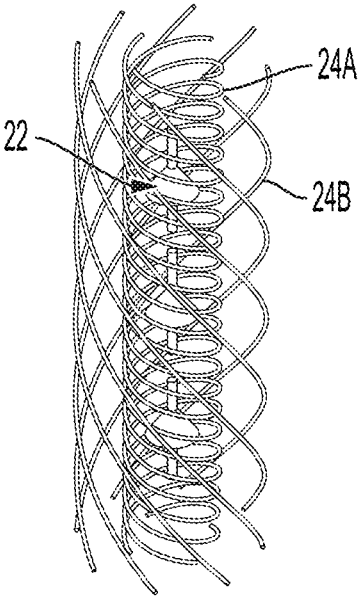
FIG. 3 is a perspective view of a portion of an antenna system according to disclosed embodiments.
Figure 4:
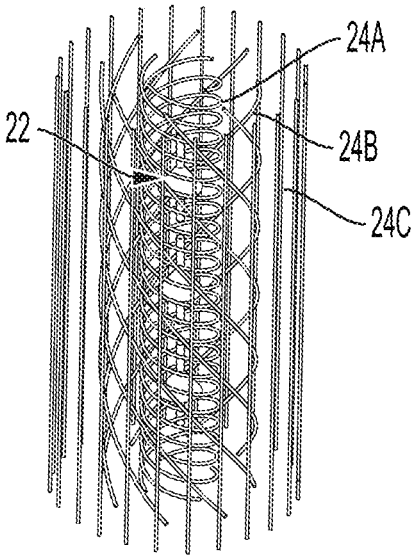
FIG. 4 is a perspective view of a portion of an antenna system according to disclosed embodiments.

FIGS. 2-4 are perspective views of portions of the antenna system 20 according to disclosed embodiments. As seen in FIGS. 2-4, in some embodiments, the plurality of linear polarization filters 24 can include a first layer of wires 24A, a second layer of wires 24B, and a third layer of wires 24C such that the first layer of wires 24A can be closest to the omni-directional vertically polarized antenna 22, the third layer of wires 24C can be furthest from the omni-directional vertically polarized antenna 22, and the second layer of wires 24B can be somewhere between the first layer of wires 24A and the third layer of wires 24C.

As also seen in FIGS. 2-4, in some embodiments, a respective pitch of each of the plurality of linear polarization filters 24 can progressively increase from the first layer of wires 24A to the third layers of wire 24C. Furthermore, in some embodiments, the respective pitch of each of the plurality of linear polarization filters 24 and a respective distance of each of the plurality of linear polarization filters 24 from the omni-directional vertically polarized antenna 22 can determine a respective amount that a respective one of the plurality of linear polarization filters 24 rotates the vertically polarized field. Further still, as seen in FIG. 4, in some embodiments, the third layer of wires 24C can be orientated parallel to the omni-directional vertically polarized antenna 22. In the specific, but non-limiting example shown in FIGS. 2-4, the first layer of wires 24A can have a radius of approximately 1 inch and include a set of four helical conductors that can include a lead of approximately 2.09 inches with a pitch of approximately 0.524 inch, the second layer of wires 24B can have a radius of approximately 2 inches and include a set of eight helical conductors that can include a lead of approximately 15.7 inches with a pitch of approximately 1.96 inches, and the third layer of wires 24C can have a radius of approximately 3 inches.

Various additional or alternative embodiments of the plurality of linear polarization filters 24 are contemplated. For example, in some embodiments, the plurality of linear polarization filters 24 can include conductive strips coupled to the one or the plurality of dielectric supports 26. Additionally or alternatively, in some embodiments, the plurality of linear polarization filters 24 can include layers of conductive ink printed on the one or the plurality of dielectric supports 26. Further still, in some embodiments, the plurality of linear polarization filters 24 can include more or less than three filters.

Figure 5:
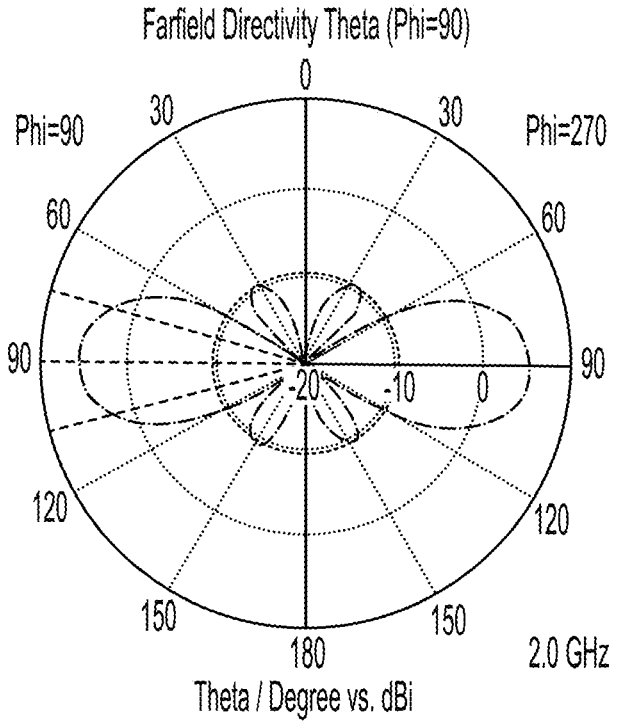
FIG. 5 is a graph of vertical polarization in the elevation plane for an antenna system according to disclosed embodiments.
Figure 6:
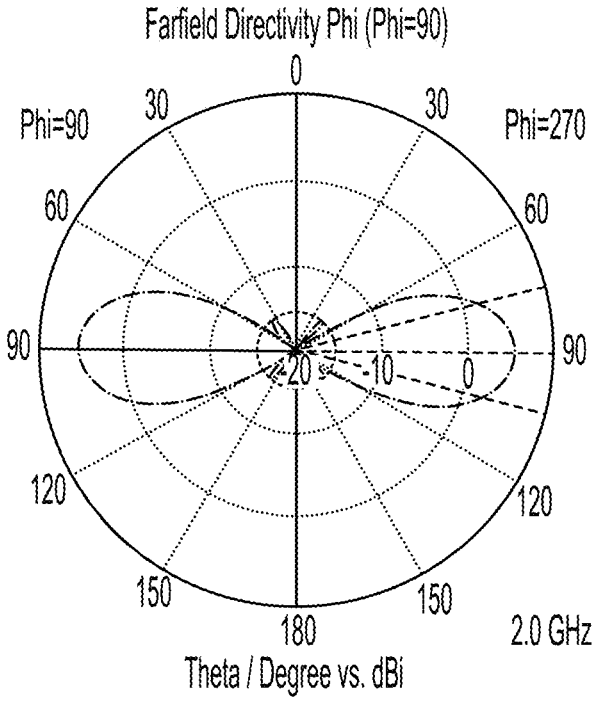
FIG. 6 is a graph of horizontal polarization in the elevation plane for an antenna system according to disclosed embodiments.
Figure 7:
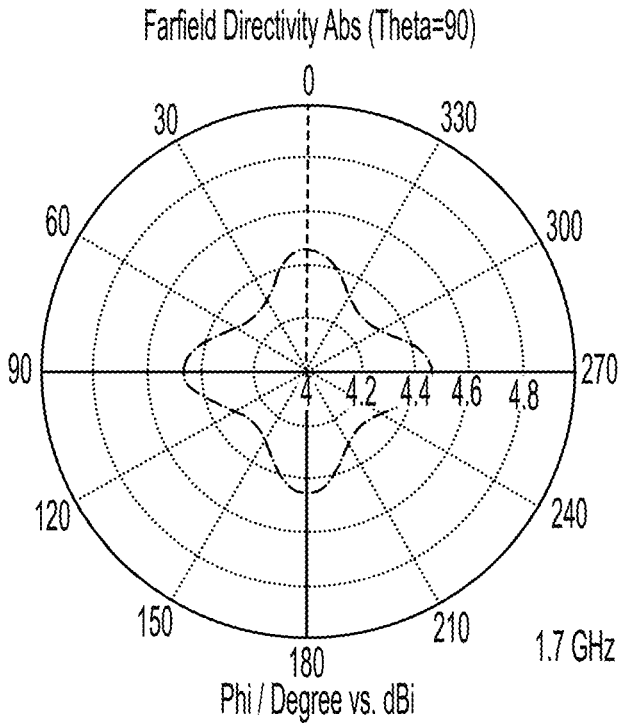
FIG. 7 is a graph of horizontal polarization in the azimuth plane for an antenna system according to disclosed embodiments.
Figure 8:
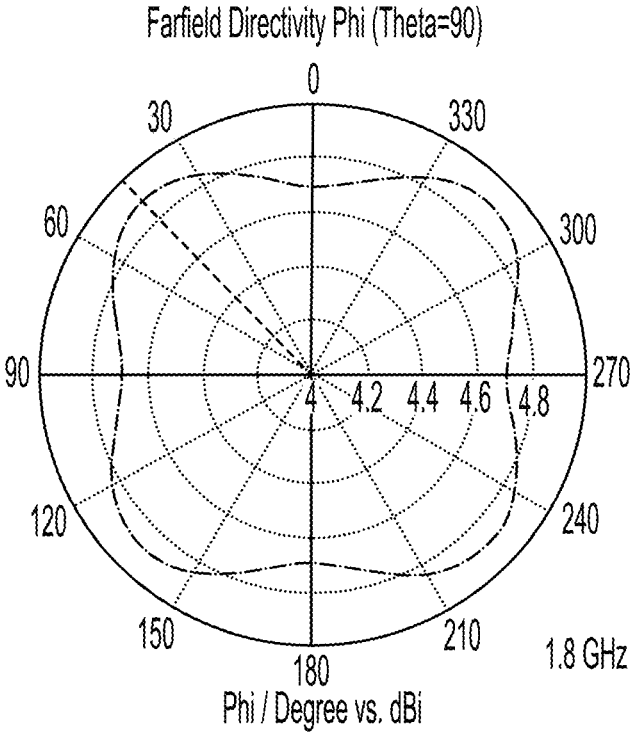
FIG. 8 is a graph of horizontal polarization in the azimuth plane for an antenna system according to disclosed embodiments.
Figure 9:
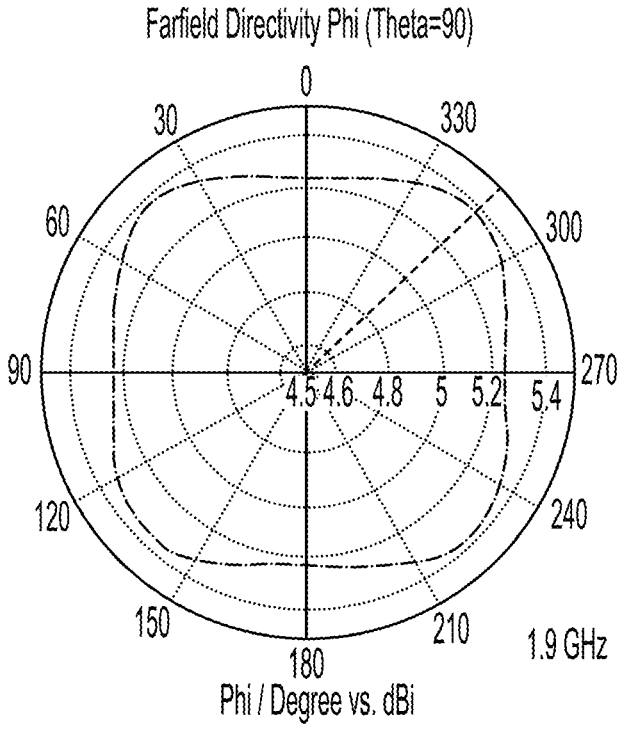
FIG. 9 is a graph of horizontal polarization in the azimuth plane for an antenna system according to disclosed embodiments.
Figure 10:
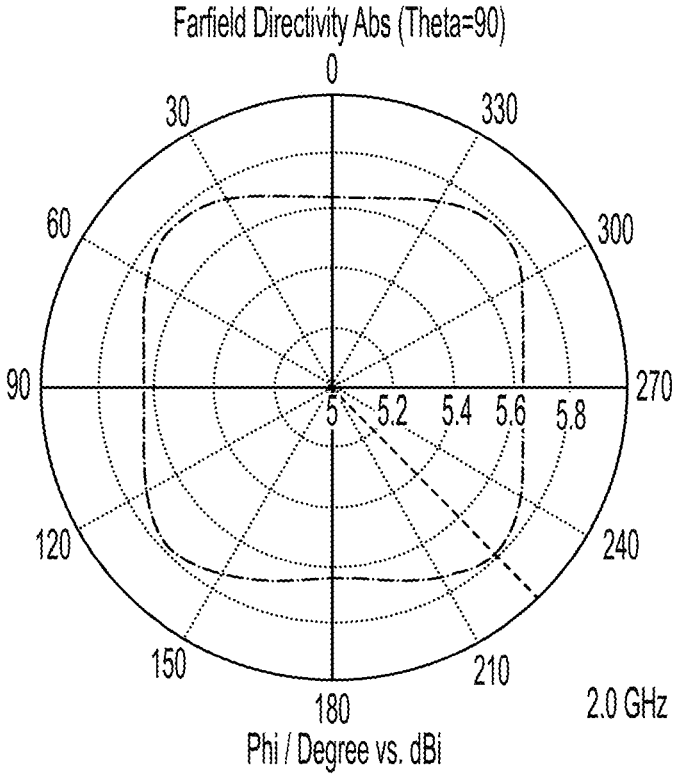
FIG. 10 is a graph of horizontal polarization in the azimuth plane for an antenna system according to disclosed embodiments.
Figure 11:
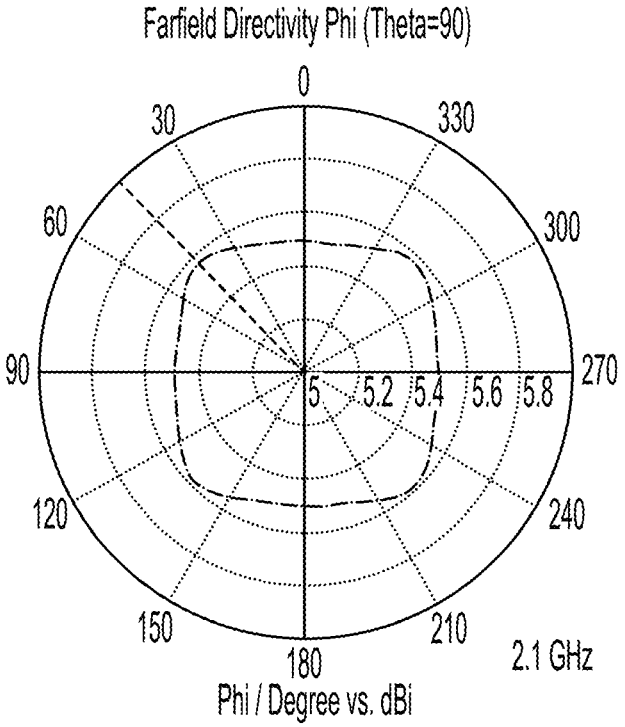
FIG. 11 is a graph of horizontal polarization in the azimuth plane for an antenna system according to disclosed embodiments.
Figure 12:
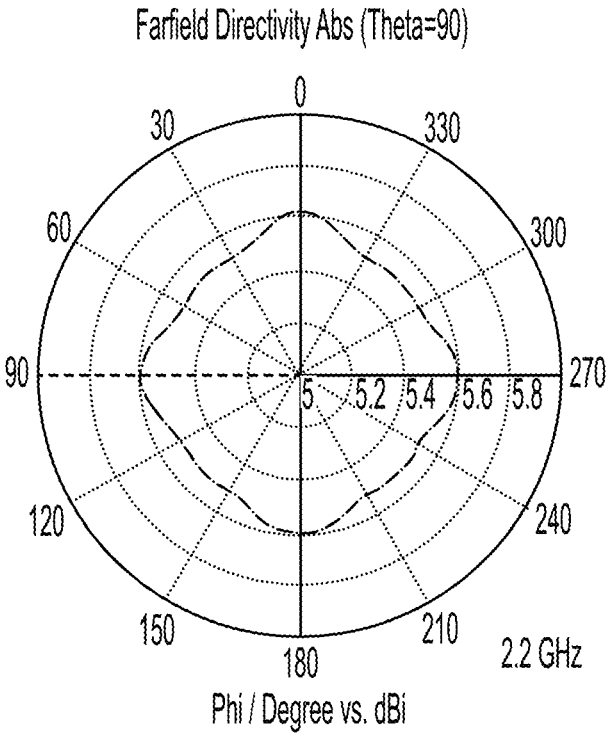
FIG. 12 is a graph of horizontal polarization in the azimuth plane for an antenna system according to disclosed embodiments.
Figure 13:
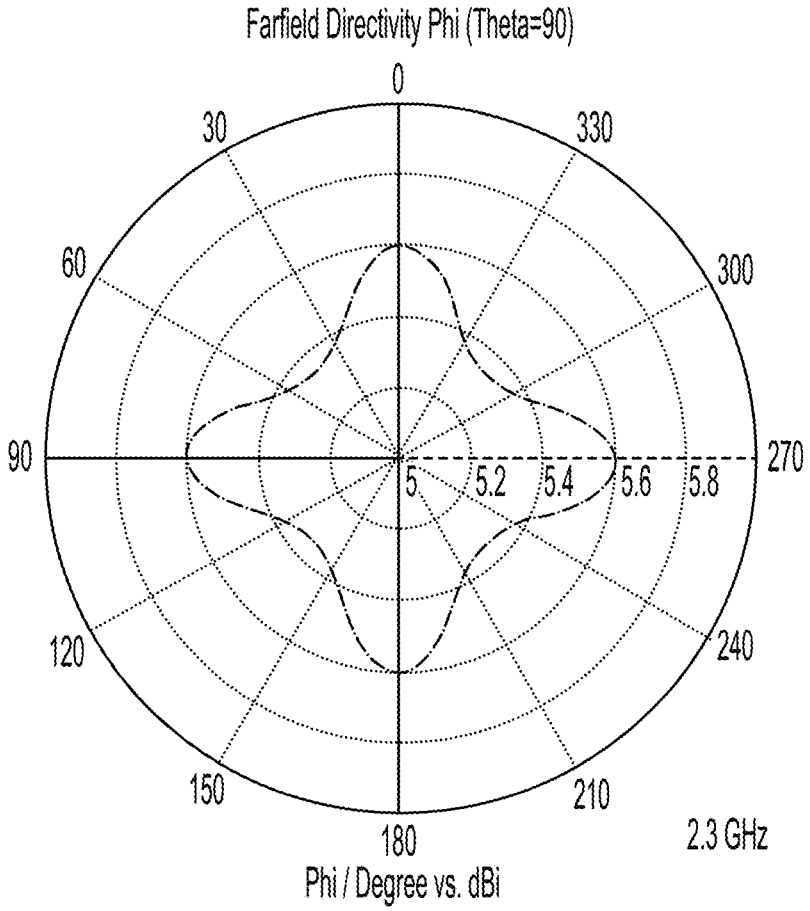
FIG. 13 is a graph of horizontal polarization in the azimuth plane for an antenna system according to disclosed embodiments.

FIG. 5 is a graph of vertical polarization in the elevation plane for the omni-directional vertically polarized antenna 22 according to disclosed embodiments, and FIG. 6 is a graph of horizontal polarization in the elevation plane for the antenna system 20 according to disclosed embodiments. As seen in the figures, in some embodiments, the horizontally polarized field can be stable across approximately 30% of a frequency bandwidth at any frequency. For example, in some embodiments, the horizontally polarized field can be stable from approximately 1.7 GHz to approximately 2.3 GHz. In this regard, FIGS. 7-13 are graphs of the horizontal polarization in the azimuth plane for the antenna system 20 at 1.7, 1.8, 1.9, 2.0, 2.1, 2.2, and 2.3 GHz according to disclosed embodiments.

Although a few embodiments have been described in detail above, other modifications are possible. For example, other components may be added to or removed from the described systems, and other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. An antenna system comprising:

an omni-directional vertically polarized antenna that generates a vertically polarized field; and a plurality of linear polarization filters concentrically surrounding the omni-directional vertically polarized antenna that progressively rotates the vertically polarized field 90° to form a horizontally polarized field outside of the plurality of linear polarization filters.

2. The antenna system of claim 1 wherein the plurality of linear polarization filters includes layers of wires coupled to one or more dielectric supports.

3. The antenna system of claim 1 wherein the plurality of linear polarization filters includes layers of conductive strips coupled to one or more dielectric supports.

4. The antenna system of claim 1 wherein the plurality of linear polarization filters includes layers of conductive ink printed on one or more dielectric supports.

5. The antenna system of claim 1 wherein components of an outermost one of the plurality of linear polarization filters are orientated parallel to the omni-directional vertically polarized antenna.

6. The antenna system of claim 1 wherein a respective pitch of each of the plurality of linear polarization filters progressively increases from an innermost one of the plurality of linear polarization filters to an outermost one of the plurality of linear polarization filters.

7. The antenna system of claim 6 wherein the respective pitch of each of the plurality of linear polarization filters and a respective distance of each of the plurality of linear polarization filters from the omni-directional vertically polarized antenna determine a respective amount that a respective one of the plurality of linear polarization filters rotates the vertically polarized field.

8. The antenna system of claim 1 wherein the horizontally polarized field is stable across 30% of a frequency bandwidth.

9. The antenna system of claim 1 wherein a number of the plurality of linear polarization filters is three.

10. A filter system comprising:

a plurality of linear polarization filters concentrically arranged relative to each other and configured to progressively rotate a vertically polarized field generated inside of the plurality of linear polarization filters 90° to form a horizontally polarized field outside of the plurality of linear polarization filters.

11. The filter system of claim 10 wherein the plurality of linear polarization filters includes layers of wires supported by one or more dielectric supports.

12. The filter system of claim 10 wherein the plurality of linear polarization filters includes layers of conductive strips supported by one or more dielectric supports.

13. The filter system of claim 10 wherein the plurality of linear polarization filters includes layers of conductive ink printed on one or more dielectric supports.

14. The filter system of claim 10 wherein components of an outermost one of the plurality of linear polarization filters are oriented parallel to a length of an antenna generating the vertically polarized field.

15. The filter system of claim 10 wherein a respective pitch of each of the plurality of linear polarization filters progressively increases from an innermost one of the plurality of linear polarization filters to an outermost one of the plurality of linear polarization filters.

16. The filter system of claim 15 wherein the respective pitch of each of the plurality of linear polarization filters and a respective distance of each of the plurality of linear polarization filters from an antenna generating the vertically polarized field determine a respective amount that a respective one of the plurality of linear polarization filters rotates the vertically polarized field.

17. The filter system of claim 10 wherein the horizontally polarized field is stable across 30% of a frequency bandwidth.

18. The filter system of claim 10 wherein a number of the plurality of linear polarization filters is three.

19. A method comprising:

providing an omni-directional vertically polarized antenna that generates a vertically polarized field; and positioning a plurality of linear polarization filters concentrically around the omni-directional vertically polarized antenna to progressively rotate the vertically polarized field 90° to form a horizontally polarized field outside of the plurality of linear polarization filters.

20. The method of claim 19 wherein a respective pitch of each of the plurality of linear polarization filters increases from an innermost one of the plurality of linear polarization filters to an outermost one of the plurality of linear polarization filters, and wherein the respective pitch of each of the plurality of linear polarization filters and a respective distance of each of the plurality of linear polarization filters from the omni-directional vertically polarized antenna determine a respective amount that a respective one of the plurality of linear polarization filters rotates the vertically polarized field.

* * * * *